United States Patent [19]

Kvinge et al.

[11] Patent Number: 4,921,408

[45] Date of Patent: May 1, 1990

[54] NON-ICING QUIET AIR-OPERATED PUMP

[75] Inventors: Daniel J. Kvinge, St. Louis Park; Frederick A. Powers; Kenneth E. Lehrke, both of Maple Grove, all of Minn.

[73] Assignee: Graco Inc., Minneapolis, Minn.

[21] Appl. No.: 277,022

[22] Filed: Nov. 28, 1988

[51] Int. Cl.[5] ..... F04B 39/02

[52] U.S. Cl. ..... 417/368; 417/375; 62/402; 60/412

[58] Field of Search ..... 417/375, 368, 396, 402, 417/403; 137/338; 62/82, 402; 60/370, 407, 412

[56] References Cited

U.S. PATENT DOCUMENTS

| | | | |
|---|---|---|---|
| 2,052,869 | 9/1936 | Coanda | 415/216 X |
| 2,893,204 | 7/1959 | Anderson et al. | 60/39.183 |
| 3,355,905 | 12/1967 | Berhold et al. | 62/402 |
| 3,938,348 | 2/1976 | Rickers | 62/427 |
| 4,127,011 | 11/1978 | Giles et al. | 62/402 |
| 4,580,406 | 4/1986 | Nims | 62/402 |

*Primary Examiner*—Louis J. Casaregola
*Assistant Examiner*—Robert N. Blackmon

[57] ABSTRACT

A silencing system is provided for an air-operated pump which also eliminates icing of the pump at higher cycle rates and humidities. The exhaust from the air motor powers an air flow inducer to induce a flow of relatively warm ambient air. The induced flow of ambient air is drawn across cold components of the air motor, and the mixed (ambient and exhaust air) exit stream routed away from the air motor. The relatively warm mixed air exhaust flow also allows noise reduction by conventional acoustical techniques without suffering performance degradation due to icing.

9 Claims, 4 Drawing Sheets

NON-ICING QUIET AIR-OPERATED PUMP

BACKGROUND OF THE INVENTION

Air-operated reciprocating piston pumps are in general well known and have been in widespread operation for many years. Such pumps have traditionally suffered from two problems which are closely interrelated to the point where the solution of one problem typically exacerbates the other. First, in the normal operation of such pumps, the expanding air in the air motor becomes quite cold and, as it exhausts, cools the valve and exhaust passages tending to build up ice in the valve and exhaust passages. If the pump should be operated at relatively high cycle rates and/or high pressures for an extended period of time, the ice build-up can be sufficient to slow or completely stall operation of the pump. Once the pump has stalled, it may need anywhere from one to several hours to thaw the blockage from the passages noted.

Such pumps have also typically produced relatively high noise levels in normal operation. Attempts to muffle the noise by restricting the exhaust of such motors using conventional muffling technology has typically led to substantially decreased performance, efficiency and increased ice build-up due to the increased restriction in the exhaust stream.

It is therefore an object of this invention to produce an air motor which is substantially quieter than existing state of the art machines.

It is yet a further object of this invention to produce an air-operated pump which is capable of operating for extended periods at high cycle rates, high pressures without icing or other decrease in performance.

It is yet a further object of this invention to provide such an air-operated pump which operates efficiently by virtue of low back pressure compared to conventionally muffled air motors.

It is yet a further object of this invention to provide an air-operated pump which may be easily and inexpensively manufactured.

SUMMARY OF THE INVENTION

An air-operated reciprocating piston pump is provided where an exhaust passage from the valve is connected to the primary fluid (or high velocity fluid) input of an air flow inducer which may be of the Coanda type. The secondary (or low velocity) fluid input of the air flow inducer is arranged so as to induce warm (room temperature) ambient air to be drawn through the flow inducer. The mixed air stream has a velocity substantially lower and temperature higher than that of the motor exhaust. The mixed air stream can be directed around the air motor, axially, radially or otherwise away from the air motor, the passage through which the mixed air stream passes being lined with sound deadening material.

The temperature of the mixed fluid stream is above freezing and serves to prevent the exhaust path downstream from the air flow inducer from falling below freezing thus preventing icing. The input air (which is drawn into the secondary fluid inlet of the air flow inducer) is drawn over a finned heat exchanger or other heat transfer mechanism which is attached to the air motor valve and exhaust nozzle block thus allowing heat transfer to the valve and exhaust nozzle block and preventing ice from forming therein. As can be appreciated, in order to keep the cold surfaces warm, the area of the heat exchanger which is exposed to the warm ambient air should be maximized compared to the area of the valve, heat exchanger and exhaust nozzle block which are exposed to the cold air stream present in the exhaust.

The warm ambient air and cold exhaust air mixture is above freezing, but may still be colder than the air motor metal temperatures. Since the mixture is above freezing, acoustical foam can be used to absorb the noise without experiencing degradation due to ice. Also, the acoustical foam can serve to insulate the air motor metal surfaces from the colder mixed air flow when the muffler exhaust passage is configured to surround the air motor.

Optionally, a second or supplemental air flow inducer may be connected to the ambient air input of the main flow inducer so as to provide additional induced flow for mixing with the cold exhaust air, and for purposes of additional warming of the valve, heat exchanger and exhaust nozzle block. The supplemental air flow inducer is operated by a small amount of compressed air which can enhance heat transfer to the heat exchanger and raise the temperature of the mixed air stream.

Also, optionally, a relatively small amount of compressed air may be bled into the valve or the exhaust nozzle to further assist in warming the exhaust stream.

These and other objects and advantages of the invention will appear more fully from the following description made in conjunction with the accompanying drawings wherein like reference characters refer to the same or similar parts throughout the several views.

A BRIEF DESCRIPTION OF THE DRAWINGS

FIG. 1 shows a schematic cross section of a typical air motor showing the air path of the preferred embodiment of the instant invention.

FIG. 2 discloses another embodiment of the instant invention when additional air flow inducer adds a supplemental effect.

DESCRIPTION OF THE PREFERRED EMBODIMENT

Figure 1:
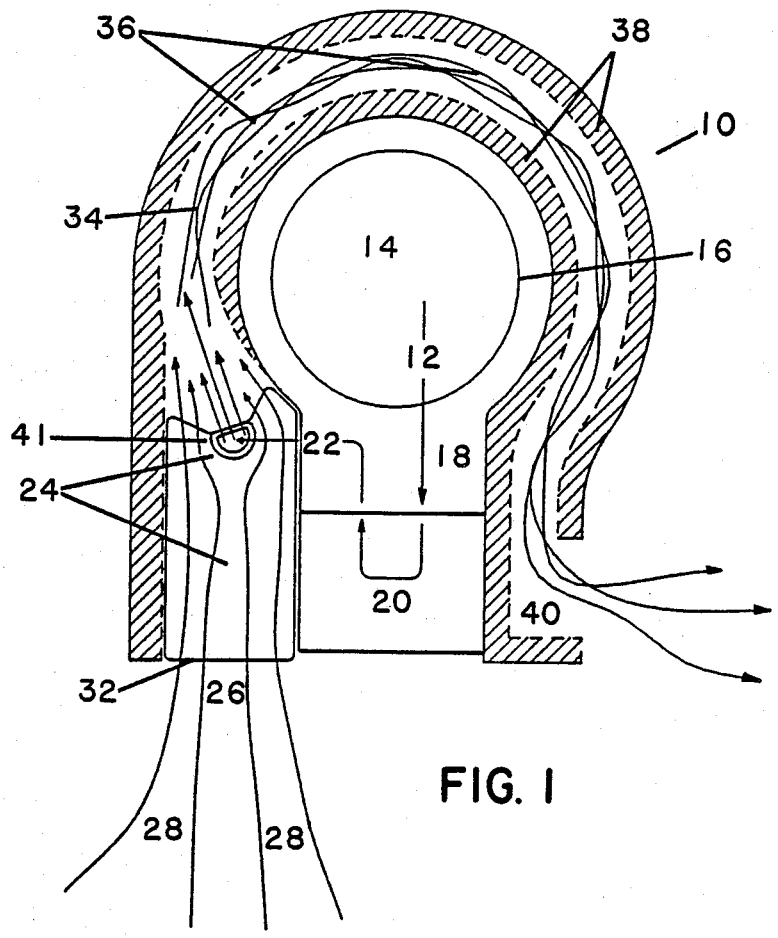

A cross section of an air-operated reciprocating piston pump air motor is shown in FIG. 1. Such air motors are in general well known in the art and the internal detailed construction need not be shown here. The motor, generally designated 10, exhausts cold exhaust air 12 from chamber 14 in the air cylinder 16. Air 12 is exhausted through first exhaust passage 8 and into air valve 20 (which may be of any conventional design) whereupon the exhaust air is passed to the primary fluid input 22 of main air flow inducer 24 and exits via the exhaust nozzle block 41.

Air flow inducer 24 may be of the venturi type, vortex type or the type generally known as a Coanda effect air amplifier, the construction of which is well known as typified by U.S. Pat. No. 2,052,869, the contents of which are hereby incorporated by reference. The secondary or low velocity fluid input 26 of flow inducer 24 receives relatively warm ambient air 28 which is drawn through the heat exchanger 32.

Heat exchanger 32 is attached in a heat conducting relationship with air cylinder 16, valve 20 and exhaust nozzle block 41, so as to extract heat from the ambient air 28 and transfer the heat into the cold exhaust nozzle block 41, air valve 20 and air cylinder 16. The expansion of exhaust gas in air cylinder 16 causes exhaust gas in passage 18 to be extremely cold (average temperatures of −30 degrees centigrade or less) which tends to lower temperatures of any contacted air motor parts below freezing and, due to the humidity in the compressed air, causes icing in air valve 20, first exhaust passage 18, exhaust nozzle block 41, air exit stream 34 or other exhaust passages.

Also, the exhaust air 12 exiting from air cylinder 16 exits at extremely high velocity. As the exhaust air 12 and ambient air 28 are mixed in air flow inducer 24, they form a mixed flow in exit stream 34. Exit stream 34 has a substantially lower velocity and higher temperature than the air leaving the exhaust nozzle block 41. The exit stream 34 passes through a silencing passage 36 which is lined with sound deadening or absorbing material such as acoustical foam 38. This reduced velocity and increased temperature serves to substantially reduce noise at the point 40 where the mixed exhaust air exits without allowing ice to form. The noise is greatly reduced compared to the traditional unmuffled air motor.

By directing passage 36 around substantially the circumference of air cylinder 16, a compact package is produced. Of course, other packaging configurations (linear, etc.) are well within the scope of this invention.

Figure 2:
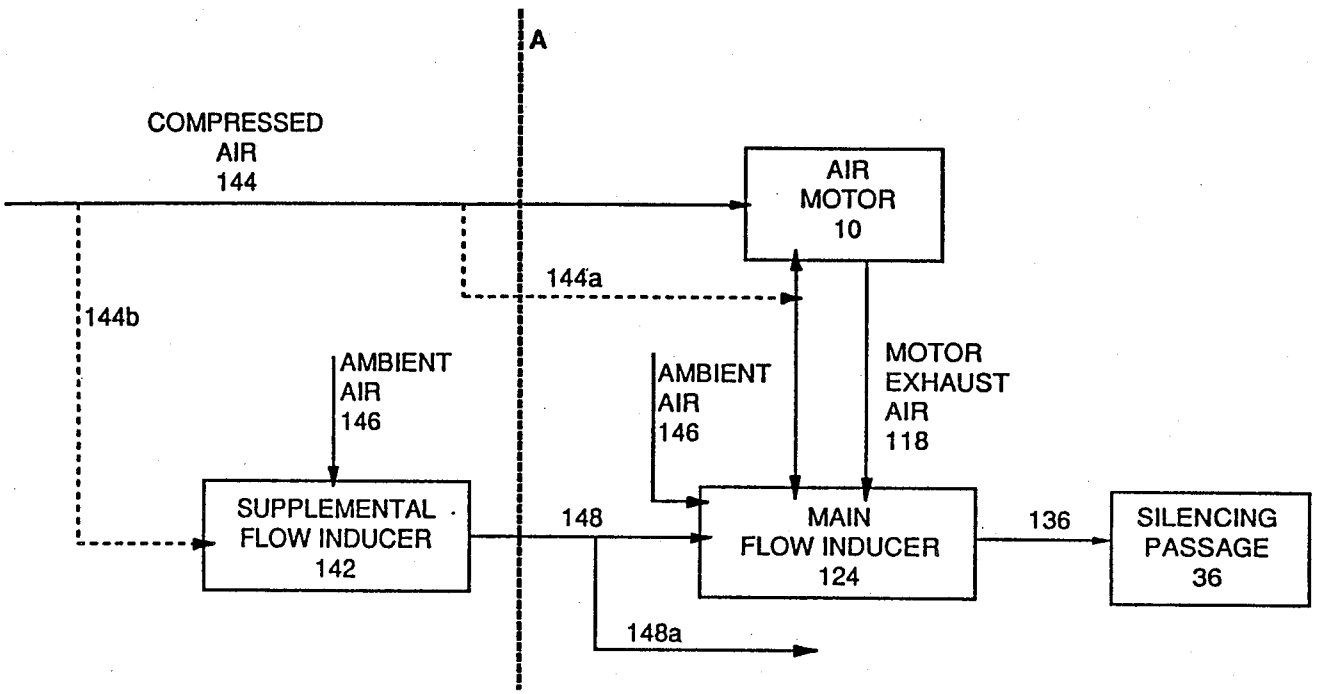

FIG. 2 shows schematically another embodiment of the instant invention wherein further induced air flow may be obtained by the use of compressed air. A source of compressed air **144*b* is connected to the primary fluid input of a supplemental air flow inducer 142. The secondary fluid input of supplemental flow inducer 142 is left open to the ambient air 146. The exit stream 148 of flow inducer 142 is thence focused via line 148*a* on those areas requiring additional heat or can be connected to the secondary fluid inlet of main flow inducer 124 which, as in the FIG. 1 embodiment, has its primary fluid inlet connected to the exhaust air 118 of the air motor. In the ambient air induction process, the ambient air warms the critical air motor components. As in FIG. 1, the mixed air exit stream 136** is directed about the air motor for silencing.

Compressed air source 144 may also be plumbed to power the air motor 10 and a portion **144*a* of compressed air source 144 may be bled into the main flow inducer 124 to induce further air flow over portions of air motor 10** to produce an additional warming effect.

Figure 3:
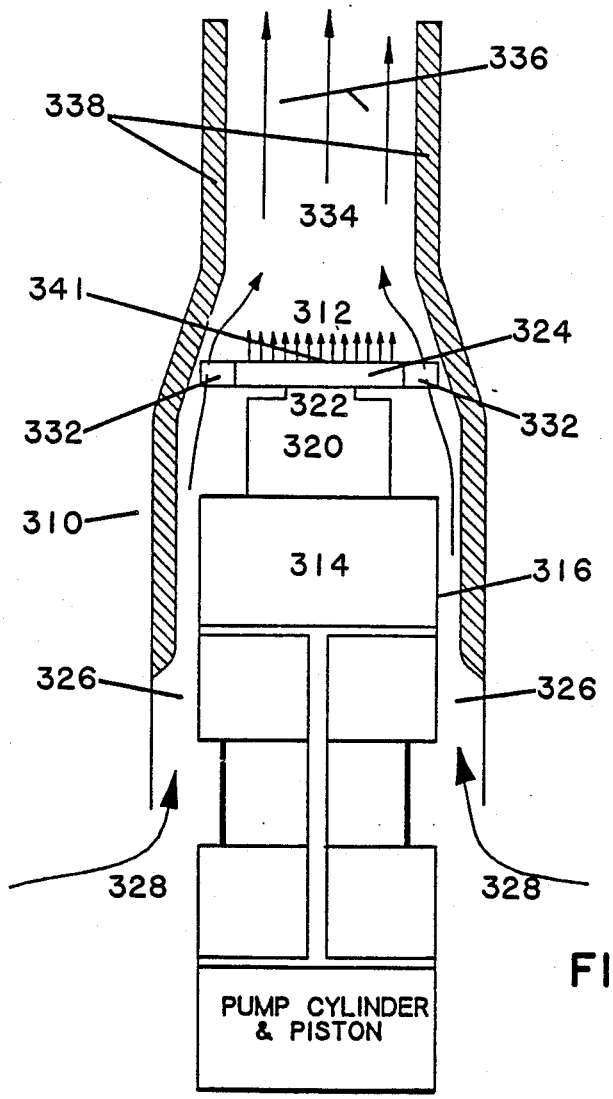
FIG. 3 shows a side cross sectional view of another embodiment of the instant invention having an axial configuration.

A cross section of an alternate embodiment of the air-operated reciprocating piston pump air motor is shown in FIG. 3. In this embodiment, the exhaust and mixing air flow paths are arranged along the axial direction of the air motor. The motor, generally designated 310, exhausts cold exhaust air 312 from chamber 314 in the air cylinder 316. Air 312 is exhausted through an exhaust passage (detail not shown) and into air valve 320 (which may be of any conventional design) whereupon the exhaust air is passed to the primary fluid input 322 of main air flow inducer 324 (as set forth above) and exits via the exhaust nozzle block 341.

The secondary or low velocity fluid input 326 of flow inducer 324 receives relatively warm ambient air 328 which is drawn through the heat exchanger 332. Heat exchanger 332 is attached in a heat conducting relationship with air cylinder 316, valve 320 and exhaust nozzle block 341, so as to extract heat from the ambient air 328 and transfer the heat into the cold exhaust nozzle block 341, air valve 320 and air cylinder 316. Exit stream 334 has a substantially lower velocity and higher temperature than the air leaving the exhaust nozzle block 341. The exit stream 334 passes through a silencing passage 336 which is lined with sound deadening or absorbing material such as acoustical foam 338.

Figure 4:
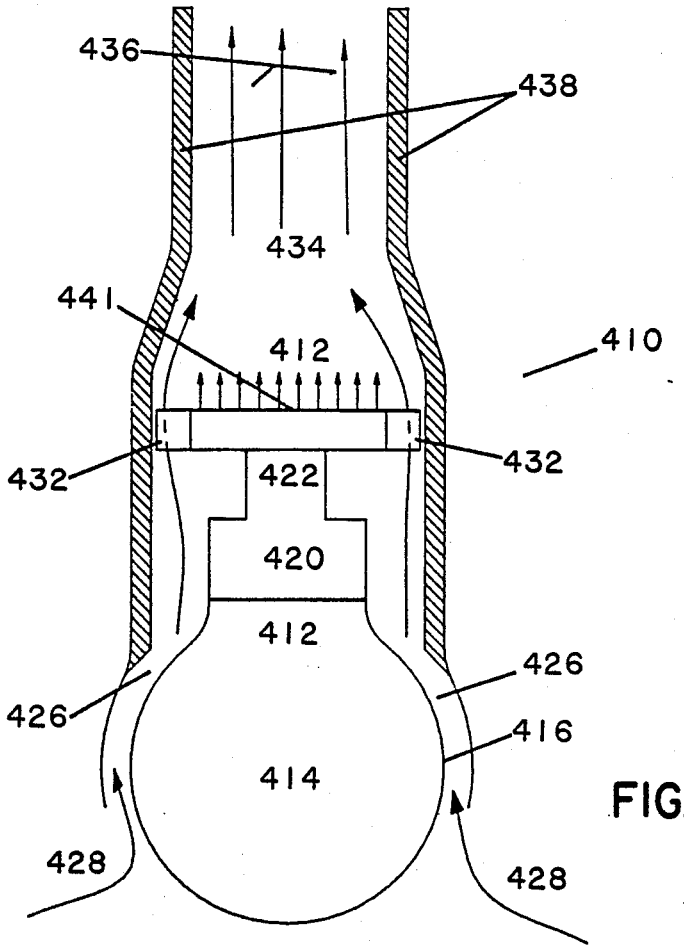
FIG. 4 shows a top cross sectional view of another embodiment of the instant invention having an axial configuration.

A cross section of another alternate embodiment of the air-operated reciprocating piston pump air motor is shown in FIG. 4. In this embodiment, the exhaust and mixing air flow paths are arranged along the radial direction of the air motor. The motor, generally designated 410, exhausts cold exhaust air 412 from chamber 414 in the air cylinder 416. Air 412 is exhausted through an exhaust passage (detail not shown) and into air valve 420 (which may be of any conventional design) whereupon the exhaust air is passed to the primary fluid input 422 of main air flow inducer 424 (as set forth above) and exits via the exhaust nozzle block 441.

The secondary or low velocity fluid input 426 of flow inducer 424 receives relatively warm ambient air 428 which is drawn through the heat exchanger 432. Heat exchanger 432 is attached in a heat conducting relationship with air cylinder 416, valve 420 and exhaust nozzle block 441, so as to extract heat from the ambient air 428 and transfer the heat into the cold exhaust nozzle block 441, air valve 420 and air cylinder 416. Exit stream 434 has a substantially lower velocity and higher temperature than the air leaving the exhaust nozzle block 441. The exit stream 434 passes through a silencing passage 436 which is lined with sound deadening or absorbing material such as acoustical foam 438.

It is contemplated that various changes and modifications may be made to the air-operated pump without departing from the spirit and scope of the invention as defined by the following claims.

What is claimed is:

1. An air motor comprising:

a valve controlling the flow of air in and out of said air motor;

an exhaust passage connected to said valve; and areas cooled by cold exhaust air, the improvement comprising means for inducing the flow of ambient atmospheric air over said cold areas, said flow inducing means being operated by exhaust flow through said exhaust passage and mixing said ambient atmospheric air with said exhaust flow to provide an above freezing mixture.

2. The air motor of claim 1 further comprising means to assist in the transfer of heat from said ambient air.

3. The air motor of claim 2 wherein said heat transfer means comprises fins to assist in heat transfer.

4. The air motor of claim 1 further comprising a muffling passage, said muffling passage being connected to said air flow inducer so as to allow the combined flow of said exhaust and said induced flow to mix, lose velocity and maintain the temperature of said combined flow above freezing.

5. The air motor of claim 4 wherein said muffling passage extends around at least a portion of said air motor.

6. The air motor of claim 5 wherein said air motor is generally cylindrical and said muffling passage extends substantially around the circumference thereof.

7. The air motor of claim 1 further comprising a supplemental air flow inducer comprising:

a primary fluid input connected to a source of pressurized air;

a secondary fluid input drawing ambient air; and an outlet focused on areas of said air motor requiring additional heat.

8. The air motor of claim 7 wherein said supplemental air flow inducer outlet is connected to said main air flow inducer secondary fluid inlet

9. The air motor of claim 1 further comprising a source of pressurized air connected to said main flow inducer signal input in addition to said exhaust flow from said exhaust passage.

* * * * *